US005649624A

United States Patent [19]

Seaton

[11] Patent Number: 5,649,624

[45] Date of Patent: Jul. 22, 1997

[54] SELF-HANGING DISPLAY PACKAGE

[75] Inventor: Robert A. Seaton, Madison, Wis.

[73] Assignee: Fiskars Inc., Madison, Wis.

[21] Appl. No.: 513,069

[22] Filed: Aug. 9, 1995

[51] Int. Cl.[6] ..... B65D 75/00

[52] U.S. Cl. ..... 206/461; 206/806; 220/23.4

[58] Field of Search ..... 206/461, 464, 206/467, 468, 469, 470, 471, 477, 478, 479, 480, 481, 482, 483, 769, 771, 776, 806; 211/49.1, 57.1; 220/23.4

[56] References Cited

U.S. PATENT DOCUMENTS

| | | | |
|---|---|---|---|
| 981,269 | 1/1911 | Hurff . | |
| 1,070,239 | 8/1913 | Ferguson . | |
| 1,738,030 | 12/1929 | Bebb . | |
| 2,273,641 | 2/1942 | Henderson . | |
| 2,629,154 | 2/1953 | Micucci . | |
| 2,698,095 | 12/1954 | Dulle . | |
| 3,313,407 | 4/1967 | Palm, Jr. . | |
| 4,034,865 | 7/1977 | Batts et al. . | |
| 4,113,109 | 9/1978 | Donnelli et al. . | |
| 4,210,246 | 7/1980 | Kuchenbecker | 206/461 |
| 4,667,827 | 5/1987 | Calcerano . | |
| 5,103,970 | 4/1992 | Nielson et al. . | |
| 5,186,345 | 2/1993 | Ching An | 206/468 X |
| 5,199,578 | 4/1993 | Pendergraph et al. . | |
| 5,209,354 | 5/1993 | Thornhill et al. | 206/461 X |
| 5,405,022 | 4/1995 | Rissley | 206/461 X |

*Primary Examiner*—Jimmy G. Foster
*Attorney, Agent, or Firm*—Foley & Lardner

[57] ABSTRACT

A self-hanging and self-engaging display package includes a rear panel having an aperture formed therein and a front panel having an integrally formed tab. A plurality of display packages form a display package system for automatically forming a chain of a plurality of self-hanging display packages. The tab of a first display package releasably engages the aperture of a second adjacent display package as the first display package is pulled out of the shipping container.

24 Claims, 2 Drawing Sheets

SELF-HANGING DISPLAY PACKAGE

FIELD OF THE INVENTION

This invention relates to point of purchase display packages and more particularly to a plurality of self-hanging display packages that self-engage as they are withdrawn from a shipping container.

BACKGROUND OF THE INVENTION

Display and presentation of merchandise are important aspects of retail. Accordingly, display packages must be suitable for the effective presentation and marketing of merchandise. Additionally, display packages must be designed to be adaptable to standard fixtures as well as to minimize the labor required by the retailer or jobber to unpack the items. Similarly, display packages must also minimize the labor and materials required to package and ship the products.

Attempts have been made to minimize costs incurred by suppliers, jobbers, and retailers in connection with the packaging, shipping and merchandising of goods in display packages. For example, U.S. Pat. No. 3,313,407 issued Apr. 11, 1967 to Palm for a "Carton for Storing and Loading Merchandise Display Cards" discloses a shipping carton configured to permit the display packages to be loaded directly onto a horizontal hanger. This device however requires a specially constructed shipping container, and is limited to unloading display packages on a horizontal hanger of a particular configuration.

Another way to reduce the labor required at store level to display packaged merchandise is disclosed in U.S. Pat. No. 5,103,970 issued Apr. 14, 1992 to Nielson et al. for a "Collapsible Display System". Nielson discloses an elongated plastic strip having a series of tabs which hold display items. This device permits display packages to be delivered to the store pre-loaded onto the strip thereby reducing in-store handling labor. However, the display packages must still be loaded onto the strip by the supplier or jobber prior to being shipped to the store. Furthermore a strip of a particular configuration is required to receive the products and secure them during shipment.

Another important aspect of product merchandising is the amount of shelf space required to display the products. Various attempts have been made to maximize sales per square footage of display. In particular U.S. Pat. No. 1,070,239 issued Aug. 13, 1913 to Ferguson discloses a plurality of display frames for displaying post cards or magazines. Each display includes an aperture located at the top of the display frame and a catch extending rearward from the bottom of the display frame. A chain of display frames is created by hanging aperture of a display frame onto catch of a previously hung display frame. However, merchandise must still be this loaded on to the device, and a supply of display frames must be maintained at the retail outlet. Further this device requires the manual construction of the hanging fixture.

Attempts have also been made to integrate a hanging feature within the display package itself. For example, U.S. Pat. No. 4,113,109 issued Sep. 12, 1978 to Donnelli et al. for a "Merchandising System For Use With Perforated Panels Or The Like" which discloses a display package formed with an attaching portion. This attaching portion permits a first package to hang directly to a perforated panel, and subsequent packages to hang directly in front of a preceding package. However, this approach requires the manual stacking of the packages and is limited to stacking horizontally.

The foregoing makes apparent that the limitations of prior art display packages and systems have not been completely satisfactorily addressed. It is therefore desirable to provide a display package that permits efficient use of shelf-space, and that is configured to minimize in store labor.

SUMMARY OF THE PRESENT INVENTION

A display package in accordance with one aspect of the present invention comprises a rear panel having an aperture to permit hanging the package on a conventional hook or the like, and a front panel having a raised portion. The front panel is secured to the rear panel forming a cavity between the raised portion and the rear panel. A tab attached to the raised portion of the front panel extends from the raised portion in a direction away from the rear panel. In accordance with another aspect of the invention the tab is formed integrally with the front panel. Yet another aspect of the display package includes a scoop proximate the aperture and extending from the rear panel.

Another aspect of this invention includes a plurality of interconnected display packages. Each display package includes a rear panel having an aperture formed therein, and a front panel extending at least over a portion of the rear panel and being secured thereto. The front panel having a raised portion defining a cavity. Each display package further includes a tab attached to and extending from the raised portion. Each tab is configured to engage the aperture of a display package disposed adjacent thereto. According to a further aspect of this invention each package includes a scoop proximate the aperture to facilitate engagement with the tab of an adjacently disposed package.

Another aspect of this invention includes a method for hanging a plurality of display packages from one another as they emerge from a shipping container. The method comprising the steps of first lifting a first display package from a shipping container holding a plurality of display packages. Another step includes engaging the aperture of a display package adjacent the first display package with the tab of the first display package. A further step includes hanging the adjacent display package from the tab of the first display package. Yet, another step includes continuing to lift the first display package and engaging the aperture of subsequent adjacent display packages from the tab of last to be engaged display package until all of the display packages are pulled out of the shipping container.

Other principal features and advantages of the invention will become apparent to those skilled in the art upon review of the following drawings, the detailed description and the appended claims.

BRIEF DESCRIPTION OF THE DRAWINGS

The invention will hereafter be described with reference to the accompanying drawings, wherein like reference numerals denote like elements, and.

DETAILED DESCRIPTION

Figure 1:
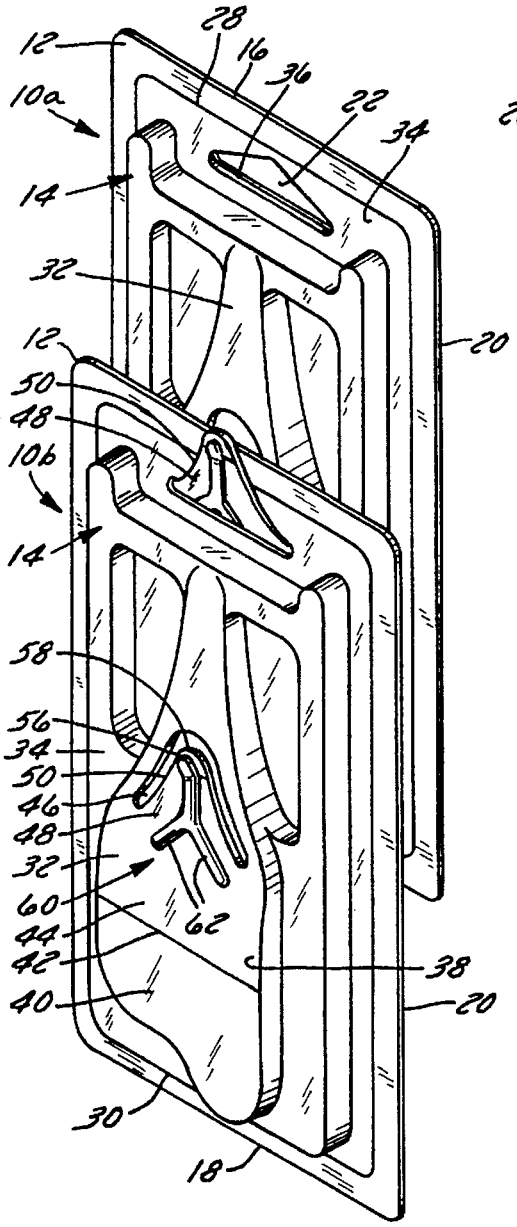
FIG. 1 is an isometric view of the display package system of the present invention.
Figure 2:
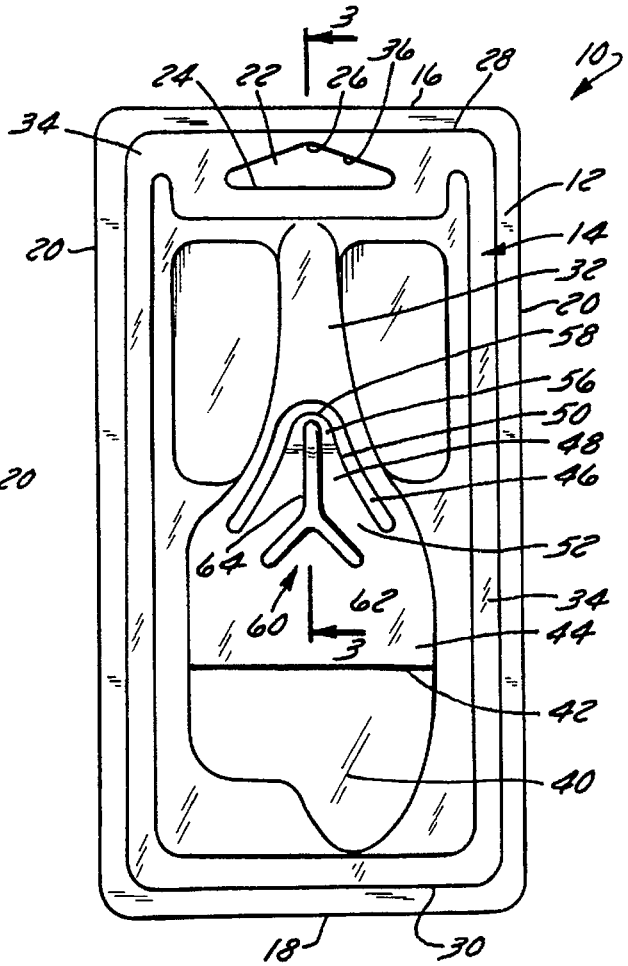
FIG. 2 is a front elevation view of the display package of the present invention.
Figure 3:
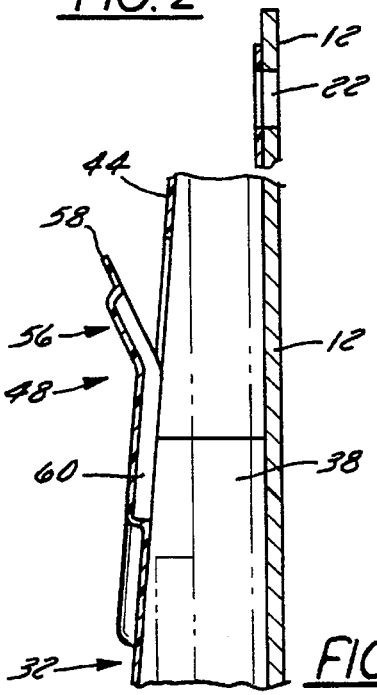
FIG. 3 is a cross-sectional view taken generally along line 3—3 of FIG. 2.

Referring to FIGS. 1–3 a detailed description of an exemplary display package 10 will be described. Display package 10 includes a rear panel 12, and a front panel 14 attached thereto. Rear panel 12 includes a top margin 16, a bottom margin 18, and a pair of side margins 20. Rear panel 12 further includes an aperture 22 proximate top margin 16. In the preferred embodiment aperture 22 has a generally triangular shape having a base 24 and an apex 26. Rear panel 12 may be constructed of cardboard, however rear panel 12 may be constructed of other suitable materials such as plastic.

Front panel 14 includes a top edge 28, a bottom edge 30, a raised portion 32 and a base portion 34. Base portion 34 is preferably adhesively attached to rear panel 12. Base portion 34 of front panel 14 includes an opening 36 in substantial alignment with aperture 22 of rear panel 12. A cavity 38 is formed between rear panel 12 and raised portion 32 of front panel 14. Merchandise is contained within cavity 38. Front panel 14 may be constructed of a transparent material such as plastic allowing for display of the merchandise contained within cavity 38.

In the exemplary embodiment, raised portion 32 includes a first region 40 originating proximate bottom edge 30 of front panel 14 and extending a given distance toward top edge 28 of front panel 14 and terminating at a line 42. The distance between rear panel 12 and first region 40 is substantially uniform. Raised portion 32 further includes an inclined region 44 originating at line 42 contiguous with first region 40 and extending toward top edge 28. The distance between inclined region 44 and rear panel 12 is equivalent to the distance between rear panel 12 and first region 40 at line 42 and then decreases at a uniform rate.

Figure 6:
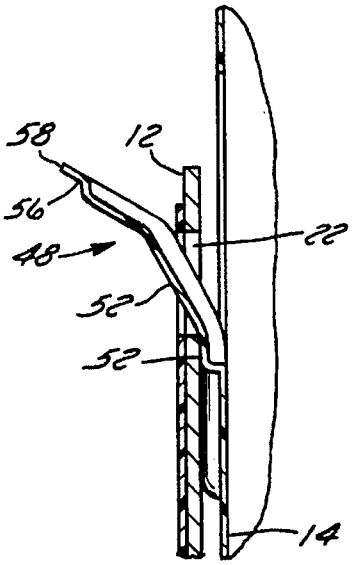
FIG. 6 is a enlarged view of area 6—6 of FIG. 5.

Raised portion 32 includes an inverted generally "U" shaped slot or opening 46 intermediate top edge 28 and bottom edge 30. In the exemplary embodiment, slot 46 is located within inclined region 44 intermediate top edge 28 and line 42. Slot 46 defines a tab 48 integrally formed with raised portion 32. Tab 48 preferably includes a symmetrical tab edge 50 and a tab base 52. Tab base 52 has a width substantially the same as the width of aperture 22. Tab 48 further includes a crease 54 and a tip 56 extending therefrom. Tip 56 extends upward and away from raised portion 32, outwardly from cavity 38 as illustrated in FIG. 6. Tip 56 has a height approximately equal to the apex 26 of aperture 22, and includes a tip end 58. In the preferred embodiment, tip end 58 extends above first region 40 by approximately 1/16 inches, and extends above inclined region 44 approximately 3/16 inches.

Tab 48, preferably, further includes an inverted "Y" shaped rib 60 integrally formed in raised portion 32. Rib 60 includes a pair of legs 62 extending from tab 48 into raised portion 32 and a top leg 64 extending toward tip end 58. However, rib 60 may have other configurations such as a "U" or an "I" shape. In the preferred embodiment, rib 60 has a convex shape having a width of approximately 1/8 inch and a height of approximately 1/16 inch. Tab 48 is flexible and resilient, such that when tab 48 is depressed toward rear panel 12, it will return to its set position upon release. In this manner tab 48 acts as a spring.

Referring again to FIG. 1, a display package system 66 including a plurality of display packages 10 will be described. First a self-hanging feature of the display package system will be described. A first display package **10*a* is releasably suspended from aperture 22 on a fixture (not shown) such as a hook or a rod. A second display package 10*b* is releasably suspended from first display package 10*a* by engagement of tab 48 of first display package 10*a* with an aperture 22 of second display package 10*b*. As tab 48 engages aperture 22, tab edge 50 in cooperation with aperture 22 acts to center second display package 10*b* as it comes to rest at the base of slot 46. Additional display packages 10 are supported in this manner forming a vertical chain of display packages in which each display package is suspended by a previously hung display package 10. In this manner display packages 10** are self-hanging and do not require any additional strip or external support.

Figure 4:
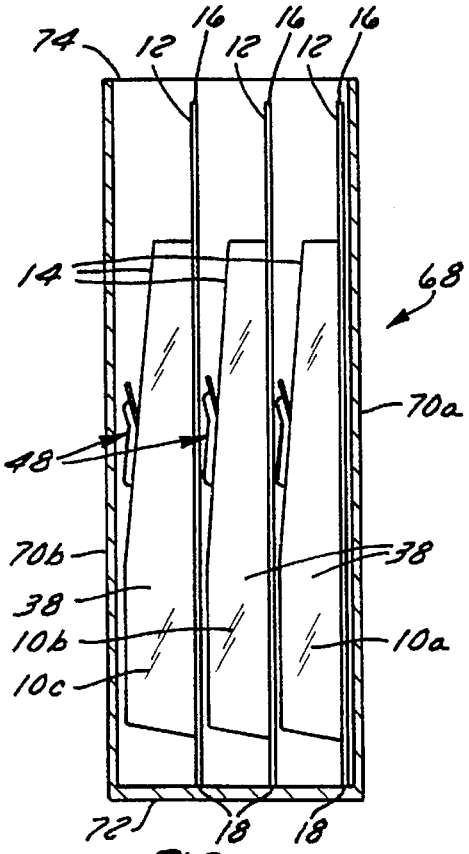
FIG. 4 is a schematic view of the display packages within the shipping container.
Figure 5:
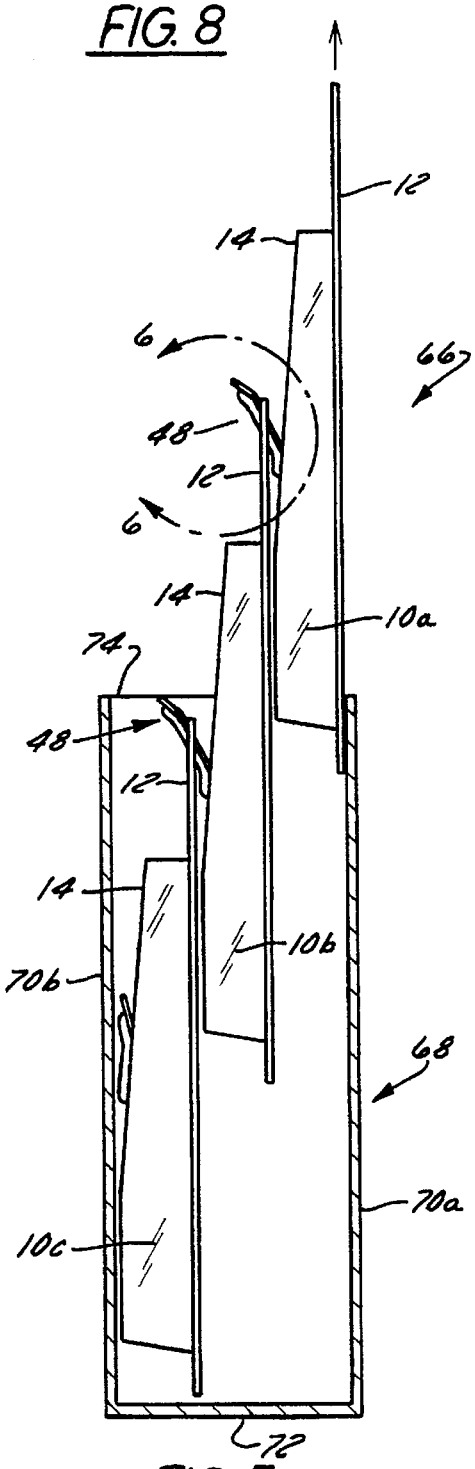
FIG. 5 is a schematic view of the display packages being pulled out of the shipping container.

Referring to FIGS. 4–6 a self-engagement feature of the display package system 66 will now be described. A plurality of display packages **10*a*, 10*b* and 10*c* are illustrated packed in shipping container 68. Shipping container 68 includes a pair of sides 70*a* and 70*b*, a bottom 72, and a top 74**.

As illustrated in FIG. 4, display packages **10*a*, 10*b*, and 10*c* are similarly positioned such that each top margin 16 of rear panel 12 is proximate top 74 of shipping container 68. Further, each rear panel 12 and front panel 14 are positioned, such that each rear panel 12 is closer to shipping container side 70*a*, and each front panel 14 is closer to shipping container side 70*b*. In this way rear panel 12 of first display package 10*a* is adjacent shipping container side 70*a*. Further, rear panel 12 of second display package 10*b* is adjacent front panel 14 of first display package 10*a*. Similarly, rear panel 12 of third display package 10*c* is adjacent front panel 14 of second display package 10*b*. As illustrated, front panel 14 of third display package 10*c* is adjacent shipping container side 70*b***.

In this packed position, each tab 48 is flexed inward toward cavity 38 by the adjacent rear panel 12. As a result tip 56 is depressed inward toward cavity 38. For example, rear panel 12 of second display package **10*b* presses against tip 56 of first display package 10*a* thereby flexing tab 48 inward toward cavity 38. In this position, the spring characteristic of tab 48 of first display package 10*a* results in tip 56 exerting a force against rear panel 12 of second display package 10*b***.

As first display package **10*a* is pulled out of or lifted from shipping container 68, the spring force of tab 48 causes tip 56 of first display package 10*a* to positively engage within aperture 22 of second display package 10*b*. As first display package 10*a* continues to be pulled from shipping container 68, tab 48 fully engages aperture 22 of second display package 10*b*. Tab 48 of second display package 10*b* will then engage aperture 22 of third display package 10*c*. In this manner all of the display packages 10*a*, 10*b* and 10*c* within shipping container 68** will self-engage and form a vertical chain of display packages.

The self-engagement of display packages **10*b* and 10*c* may be facilitated by simultaneously moving first display package 10*a* in a direction toward second container side 70*b* as first display package 10*a* is being pulled out of shipping container 68. In this manner inclined region 44 permits display packages to pivot about line 42 to better position tab 48 to facilitate engagement of aperture 22** of the adjacent display package.

Although FIGS. 4 and 5 illustrate three display packages **10*a*, 10*b* and 10*c*, a greater number of display packages may packed in shipping container 68. In this embodiment, a vertical chain of 10 display packages containing scissors may be formed. The number of display packages which may be packed within shipping container 68 is limited by the strength of tab 48 and the weight of the merchandise held within cavity 38 of display package 10**.

Figure 7:
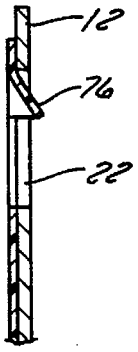
FIG. 7 is a fragmentary view of an alternative embodiment of the aperture in a display package.
Figure 8:
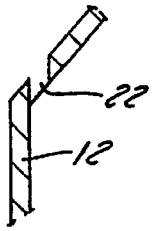
FIG. 8 is a fragmentary view of another alternative embodiment of the rear panel and aperture in a display package.

In an alternative embodiment as illustrated in FIG. 7, front panel 14 includes a scoop 76 which extends through rear panel aperture 22. Scoop 76 facilitates the engagement of tab 48 with aperture 22. Scoop 76 may have the form of an angled member or may have a curved surface. As a first display package is pulled out of shipping container 68, tab 48 engages scoop 76 which then guides tab 48 through aperture 22. In this manner scoop 76 facilitates the engagement of tab 48 of a first display package with the aperture 22 of a second display package. Accordingly, in this alternative embodiment, tab 48 may be flexible and resilient as in the exemplary embodiment, or tab 48 may rigidly extend from front panel 14 in a direction away from cavity 38. Alternatively, as illustrated in FIG. 8, rear panel 12 may be angled rearwardly away from cavity 38 proximate top margin 16.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims. For example, rear panel 12 and front panel 14 may be an integrally formed clamshell, whereby rear panel 12 and front panel 14 are integrally formed along a common edge. Additionally, tab 48 may include a crease at its base, such that the entire tab 48 is formed to angle out from front panel 14. Tab 48 may also be a separate member attached to front panel 14. Also, aperture 22 may have various shapes, such as rectangular or oval. Additionally, scoop 76 may be integrally formed with rear panel 12 or attached thereto. Aperture 22 may be formed solely within rear panel 12 such that when a second display package is suspended from a first display package, tab 48 does not extend through front panel 14 of the first display package 10. These other configurations and constructions are considered to be within the scope of the present invention. Thus, these and other substitutions and modifications may be made in the design and arrangement of elements disclosed herein without departing from the scope of the appended claims.

What is claimed is:

1. A display package comprising:

a rear panel having an aperture formed therein;

a front panel extending at least over a portion of the rear panel and being secured thereto, the front panel having a raised portion defining a cavity, the front panel further having a top edge and a bottom edge opposite thereto; and a tab attached to the raised portion and extending therefrom away from the cavity toward the top edge.

2. The display package of claim 1, wherein the tab is integrally formed with the raised portion.

3. The display package of claim 2, wherein the aperture is generally triangularly shaped and wherein the tab has a symmetrical tab edge to self-center a second display package suspended from the tab.

4. The display package of claim 3, wherein the tab is triangularly shaped.

5. The display package of claim 1, wherein the tab is flexible and resilient.

6. The display package of claim 1, wherein the tab includes a rib formed therein.

7. The display package of claim 1, wherein the rear panel includes a top margin and a bottom margin, and wherein the rear panel is angled rearwardly away from the cavity in a region proximate the top margin.

8. The display package of claim 1, wherein the front panel includes a top edge and a bottom edge, and wherein the cavity has a certain depth suitable to receive an item to be displayed, the depth being greater in a region proximate the bottom edge than in a region proximate the top edge.

9. The display package of claim 8, wherein the cavity comprises a first region extending from the bottom edge and having a substantially uniform depth and the first region merging into a second region extending toward the top edge, the second region having a depth decreasing at a substantially uniform rate toward the top edge.

10. A display package comprising:

a rear panel having an aperture formed therein;

a front panel extending at least over a portion of the rear panel and being secured thereto, the front panel having a raised portion defining a cavity; and a tab attached to the raised portion and extending therefrom away from the cavity, the tab being integrally formed with the raised portion;

wherein the tab is formed by an opening in the raised portion.

11. A display package comprising:

a rear panel having an aperture formed therein;

a front panel extending at least over a portion of the rear panel and being secured thereto, the front panel having a raised portion defining a cavity; and a tab attached to the raised portion and extending therefrom away from the cavity, the tab including a rib formed therein;

wherein the rib extends from the tab into the raised portion and has the form of an inverted "Y".

12. The display package of claim 11, wherein, the tab includes a tip extending outwardly from the raised portion.

13. A display package comprising:

a rear panel having an aperture formed therein;

a front panel extending at least over a portion of the rear panel and being secured thereto, the front panel having a raised portion defining a cavity; and a tab attached to the raised portion and extending therefrom away from the cavity;

the rear panel including a top margin and a bottom margin, the display package further including a scoop proximate the aperture and extending away from the rear panel in a direction toward the bottom margin.

14. The display package of claim 13, wherein the scoop is integrally formed with the front panel, the scoop extending through the aperture of the rear panel.

15. A display package system, comprising a plurality of interconnected display packages, each display package comprising:

a rear panel having an aperture formed therein;

a front panel extending at least over a portion of the rear panel and being secured thereto, the front panel having a raised portion defining a cavity, the front panel further having a top edge and a bottom edge opposite thereto; and a tab attached to the raised portion and extending therefrom toward the top edge;

wherein each tab is configured to engage the aperture of a display package disposed adjacent thereto.

16. The display package system of claim 15, wherein each tab is integrally formed with the raised portion.

17. The display package system of claim 15, wherein each tab is flexible and resilient.

18. The display package system of claim 17, wherein each tab includes a rib formed therein.

19. A display package system, comprising a plurality of interconnected display packages, each display package comprising:

a rear panel having an aperture formed therein;

a front panel extending at least over a portion of the rear panel and being secured thereto, the front panel having a raised portion defining a cavity; and a tab attached to the raised portion and extending therefrom;

each tab being configured to engage the aperture of a display package disposed adjacent thereto;

each tab being flexible and resilient and including a rib formed therein;

wherein each rib extends from the tab into the raised portion and has the form of an inverted "Y".

20. The display package system of claim 19, wherein each tab includes a tip extending outwardly from the raised portion.

21. A display package system, comprising a plurality of interconnected display packages, each display package comprising:

a rear panel having an aperture formed therein;

a front panel extending at least over a portion of the rear panel and being secured thereto, the front panel having a raised portion defining a cavity; and a tab attached to the raised portion and extending therefrom;

each tab being configured to engage the aperture of a display package disposed adjacent thereto;

wherein each display package further includes a scoop proximate the aperture to facilitate engagement of a tab of a first display package within an aperture of an adjacently disposed display package.

22. A method for hanging a plurality of display packages from one another as they emerge from a shipping container, comprising the steps of:

lifting a first display package from a shipping container holding a plurality of display packages, wherein each display package includes a rear panel having an aperture formed therein, a front panel extending at least over a portion of the rear panel and being secured thereto, the front panel having a raised portion defining a cavity, and a tab attached to the raised portion and extending therefrom away from the cavity;

engaging the aperture of a second display package adjacent the first display package with the tab of the first display package as the first display package is lifted from the container; and successively engaging remaining display packages as the first display package continues to be lifted away from the container.

23. The method as recited in claim 22, wherein the tab of the preceding display package automatically springs away from the cavity as the tab engages the aperture.

24. The method as recited in claim 22, wherein the step of lifting the first display package further includes simultaneously moving the first display package toward the adjacent display packages to facilitate self-engagement of the tab within the aperture.

* * * * *